US012729037B2

(12) United States Patent
Long

(10) Patent No.: US 12,729,037 B2
(45) Date of Patent: Sep. 8, 2026

(54) BOX FOR CARDS

(71) Applicant: Gregory Long, Mount Pleasant, WI (US)

(72) Inventor: Gregory Long, Mount Pleasant, WI (US)

( * ) Notice: Subject to any disclaimer, the term of this patent is extended or adjusted under 35 U.S.C. 154(b) by 119 days.

(21) Appl. No.: 18/984,836

(22) Filed: Dec. 17, 2024

(65) Prior Publication Data

US 2025/0214742 A1 Jul. 3, 2025

Related U.S. Application Data

(60) Provisional application No. 63/615,126, filed on Dec. 27, 2023.

(51) Int. Cl.
*B65D 5/42* (2006.01)

(52) U.S. Cl.
CPC ..... *B65D 5/4266* (2013.01)

(58) Field of Classification Search
CPC ..... B65D 5/48014; B65D 5/5007; B65D 5/2009; B65D 5/5213; B65D 5/4266; B65D 5/5004; B65D 5/0005
USPC ..... 229/100, 101.1, 101.2, 104, 120.08, 229/120.13, 120.21, 120.28, 167, 120.12, 229/120.18, 125.02; 206/205, 216, 591, 206/736, 765
See application file for complete search history.

(56) References Cited

U.S. PATENT DOCUMENTS

| | | | | |
|---|---|---|---|---|
| 2,614,746 | A * | 10/1952 | Frankenstein | B65D 5/6626 229/160 |
| 3,804,321 | A | 4/1974 | Forbes, Jr. | |
| 5,495,983 | A | 3/1996 | Lelek | |
| 11,492,170 | B2 * | 11/2022 | Mellecker | B65D 5/48014 |
| 2008/0054056 | A1 * | 3/2008 | Lin | B65D 5/0095 229/120.08 |

FOREIGN PATENT DOCUMENTS

| | | |
|---|---|---|
| JP | 7351443 B2 | 9/2020 |

* cited by examiner

*Primary Examiner* — Christopher R Demeree
(74) *Attorney, Agent, or Firm* — James Earl Lowe, Jr.

(57) ABSTRACT

A box having a front section, a back section having a space reducing tab, two symmetrical side sections, each having a fold down tab, and a cover section. The box is for two or more different sized products comprising a box configuration that may be shipped and stored in flat condition.

2 Claims, 7 Drawing Sheets

BOX FOR CARDS

BACKGROUND

This disclosure relates to folding paperboard cartons of the type commonly employed in the packaging of two or more products of different sizes and dimensions.

When shipping standard size gaming cards/sports cards which are 2.5×3.5 inches, or top loaders (clear hard plastic protectors) that are 3×4 inches, different size boxes are required.

SUMMARY

Disclosed is a box that can accommodate different size items, such as game cards and top loaders. The box has a front section, a back section having a space reducing tab, two symmetrical side sections, each having a fold down tab, and a cover section. The front section is attached to the back section along the first front fold line with the second parallel front fold line spaced apart from the first front fold line. The front section is dimensioned to overlap all the back section. The cover section is dimensioned to overlap at least part of the back section, and the cover section is attached to the front section along the first cover fold line with the second parallel cover fold line spaced apart from the first cover fold line. The two side sections are attached to opposed sides of the back section by four spaced apart side fold lines so that the size of the box is reduced as needed in one plane and is dimensioned to fold over at least part of the back section. Each fold down tab is cut or perforated on at least one side from the side section with the first fold line attached to the side section and the second fold line spaced apart from the first fold line so that the first part of the fold down tab can be folded towards the inside of the box when the side section is folded over the back section so that the fold down tab acts as the weak spring and the space reducer in the second plane. The space reducing tab is cut or perforated along two opposed sides from the back section. The space reducing tab is attached to the back section along the first space reducing tab fold line toward the inside of the back section so that the space reducing tab folds outward.

It is an object of the present disclosure to provide a one-piece paperboard carton for two or more different sized products comprising a box configuration that may be shipped and stored in flat condition. It is also an object of the present disclosure to help reduce the amount of movement of items within the box.

Figure 1:
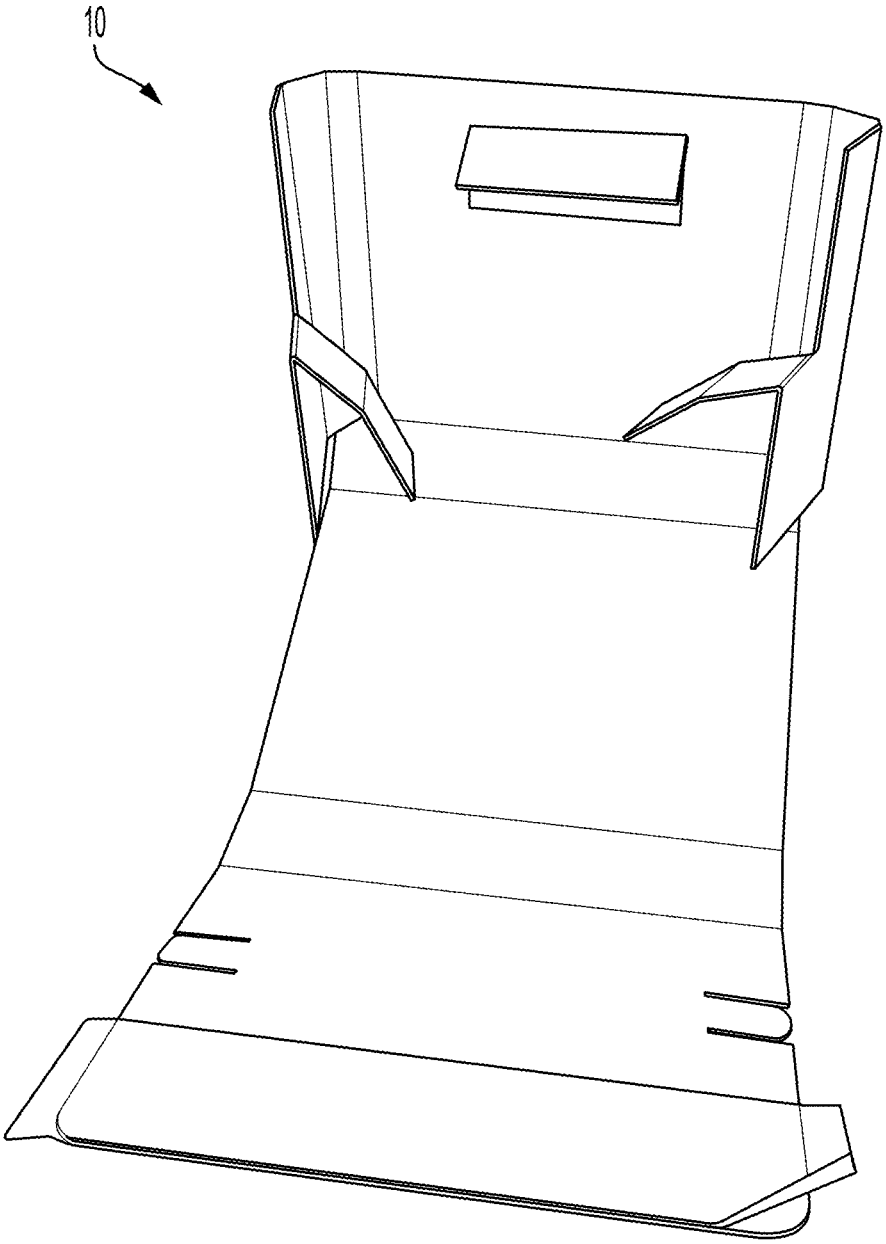
FIG. 1 is a perspective view of a box according to this disclosure partially folded.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF A PREFERRED EMBODIMENT

Disclosed is a box 10 made from N flute corrugated cardboard. The box is cut from a flat T shaped blank. The blank includes various fold lines and cuts or perforations. The box 10 provides an advantage over other boxes for the box 10 can hold a variable number of playing cards, including items of different size, while eliminating all free space along all three planes of motion no matter the quantity inside. This is accomplished by folded tabs and cut edges that are sized to engage the items within the box 10.

The sides of the box have rounded outside edges, which along with folded tabs, help to provide the box with a cushion effect. This helps prevent items in the box from moving around inside the box. The box also includes a tear strip 46 and a piece of removable tape 50 (see FIG. 1) that can be used to seal the box.

More particularly, the box 10 can accommodate standard size gaming cards/sports cards 52 which are 2.5×3.5 inches. In addition, the box 10 can accommodate top loaders 54 (clear hard plastic protectors) that are 3×4 inches. One does not need two separate size boxes for something that is so close in size. The features of this box allow the smaller sized contents to fit inside, with no room to move.

The side folds prevent rattling of the contents inside. The side folds also reduce the inside box size from the 4 to 3.5 inches to prevent unwanted motion in one plane. A pop-up space reducing tab 16 acts as a space reducer, from 3.0 to 2.5 inches, and a spring in a second plane, and two fold down tabs 17 act like weak springs to hold down the contents in the 3rd plane.

Figure 2:
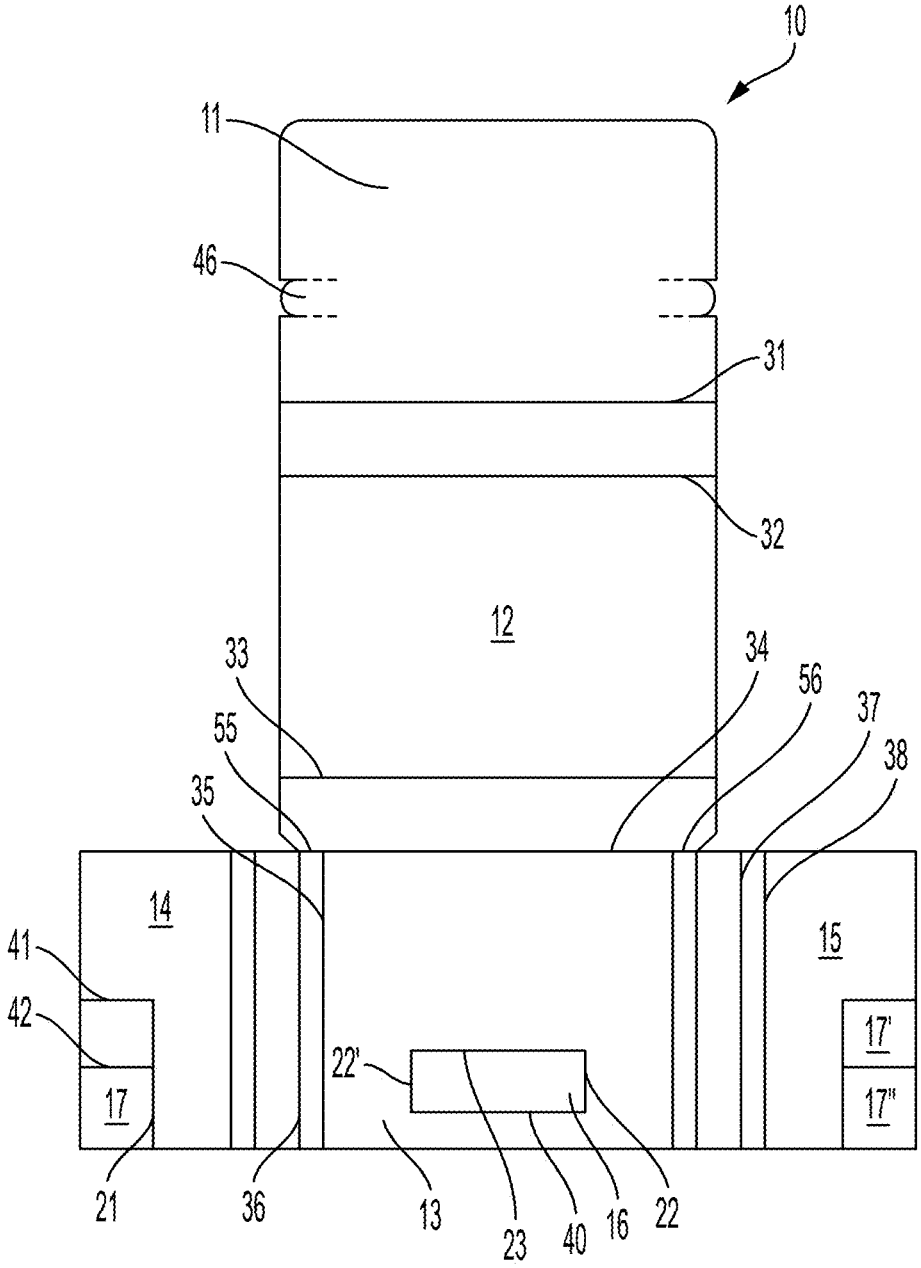
FIG. 2 is a top view of a T shaped blank used to form the box.

More particularly, as shown in FIG. 2, the box 10 includes three sections: a back section 13, a front section 12, and an overlapping cover section 11, and two symmetrical sides 14 and 15, each side having four fold lines 35 to 38 and 2 cut or tear lines 55 and 56 that can reduce the size of the box 10 as needed in one plane. The box 10 also has a space reducing tab 16 cut from the back section 13 that can lie flat parallel to the remainder of the back section when larger items are packaged in the box, or it can be bent upward to reduce the space in the box for smaller items, where it also acts as a weak spring in a second plane. The front section 12 overlaps the back section 13, and the overlapping cover section 11 reinforces the back section 13. The side sections 4 and 15 fold over the back section 13, with each side having a two-piece fold down tab 17 that acts as a space reducer and weak spring inside the box 10 in a third plane. To complete the box 10, there are also folds 31 to 34 and 40 to 42, and cut or perforation lines 21 to 23 and 55 and 56.

More particularly, the front section 12 is attached to the back section along the first front fold line 34 with the second parallel front fold line 33 spaced apart from the first front fold line 34. The front section 12 is dimensioned to overlap all the back section 13. The cover section 11 is dimensioned to overlap at least part of the back section 13, and the cover section 11 is attached to the front section 12 along the first cover fold line 32 with the second parallel cover fold line 31 spaced apart from the first cover fold line 32. The two side sections 14 and 15 are attached to opposed sides of the back section 13 by four spaced apart side fold lines 35 to 38 so that the size of the box 10 is reduced as needed in one plane and is dimensioned to fold over at least part of the back section 13. Each fold down tab 17 is detached on at least one side 21 from its respective side section with the first fold line 41 attached to the side section and the second fold line 42 spaced apart from the first fold line 41 so that the first part 17" of the fold down tab 17 can be folded towards the inside of the box 10 when the side section is folded over the back section 13 so that the fold down tab 17 acts as the weak spring and the space reducer in the second plane. The space reducing tab 16 is detached along two opposed sides 22, 22' from the back section, as well as along a bottom edge 23. The space reducing tab is attached to the back section along the first space reducing tab fold line 40 toward the outside of the back section so that the space reducing tab folds upward.

Figure 3:
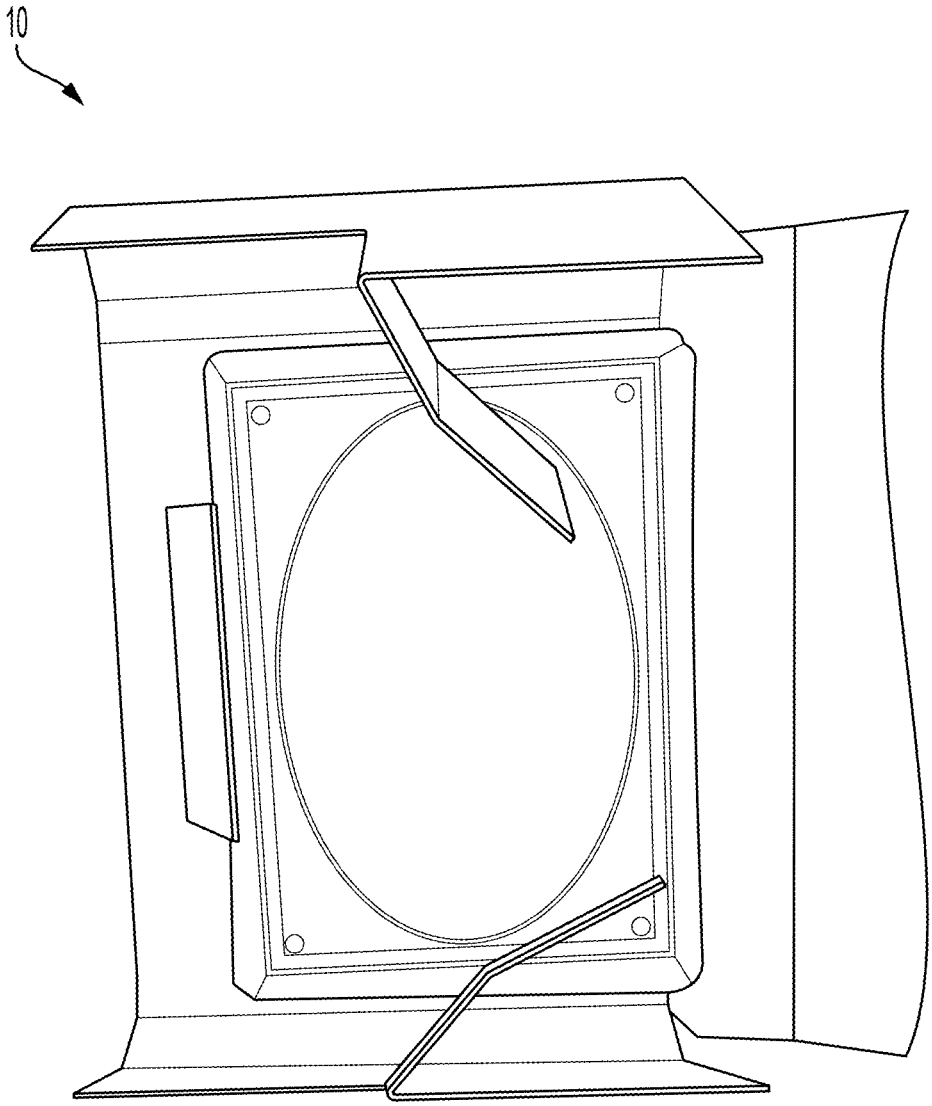
FIG. 3 is a top perspective view of the box with playing cards.
Figure 4:
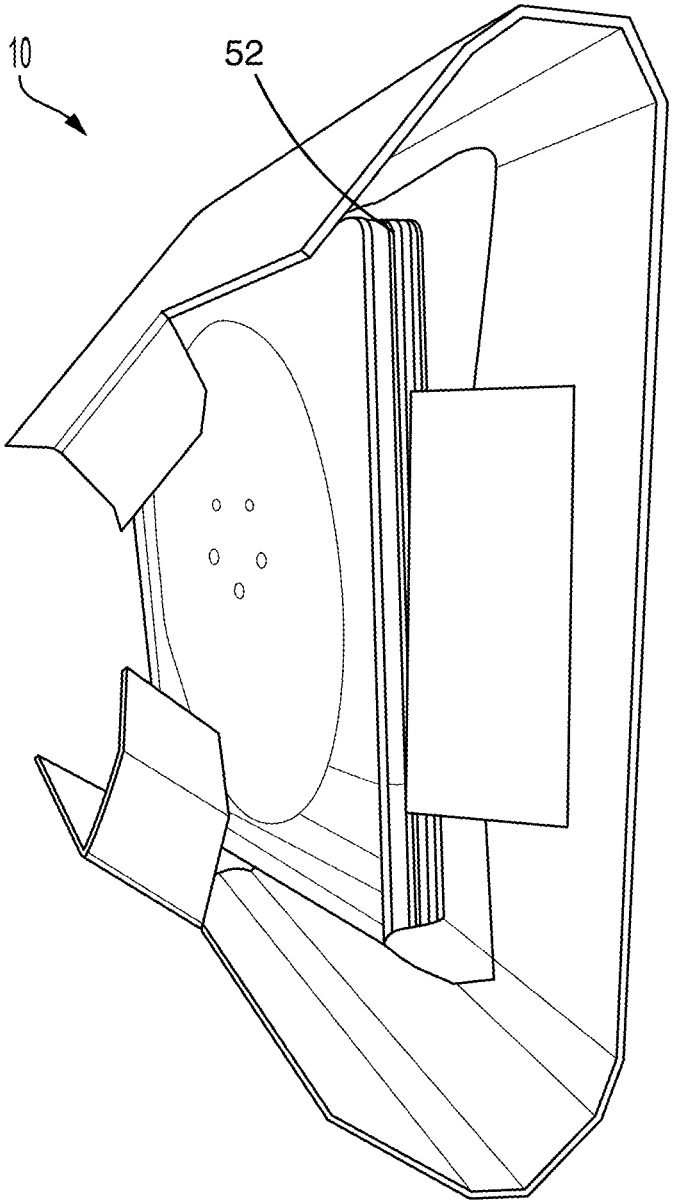
FIG. 4 is an end perspective view of the box with the playing cards.
Figure 5:
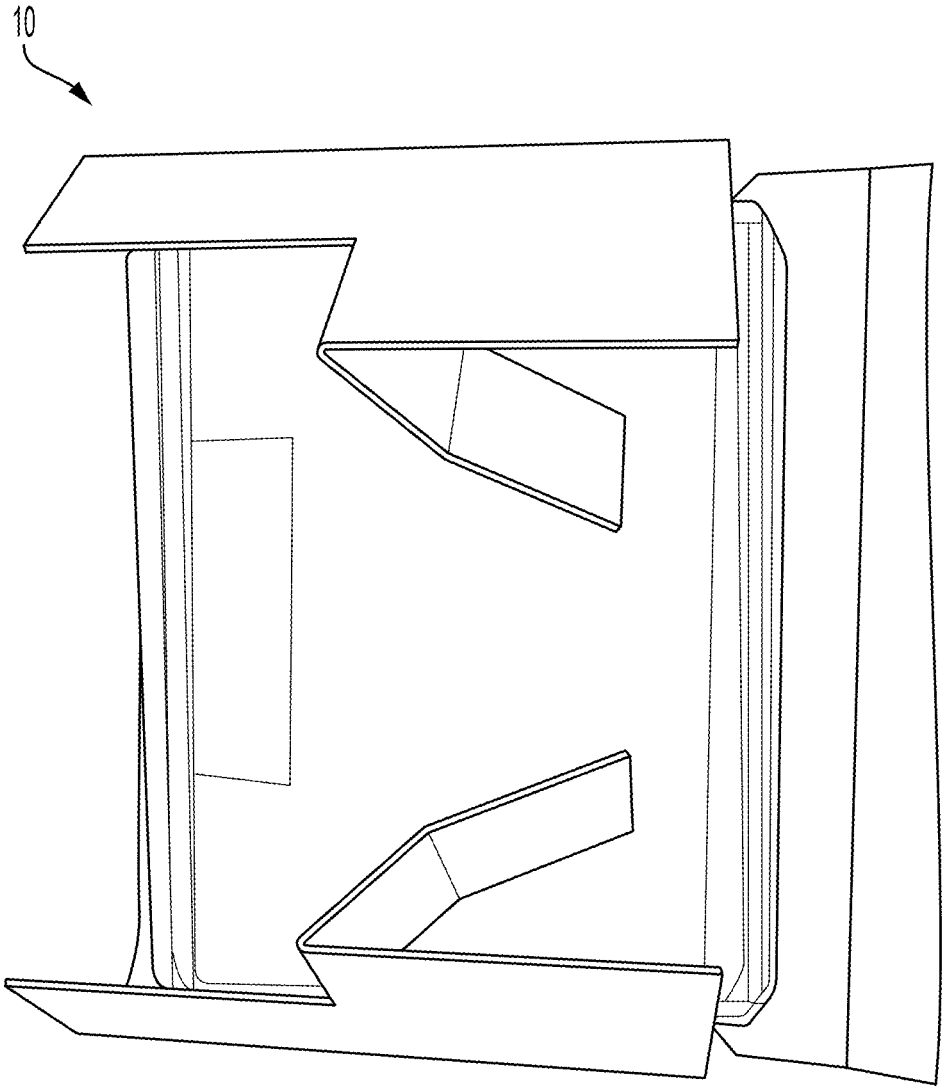
FIG. 5 is a top perspective view of the box with the box including plastic card covers.
Figure 6:
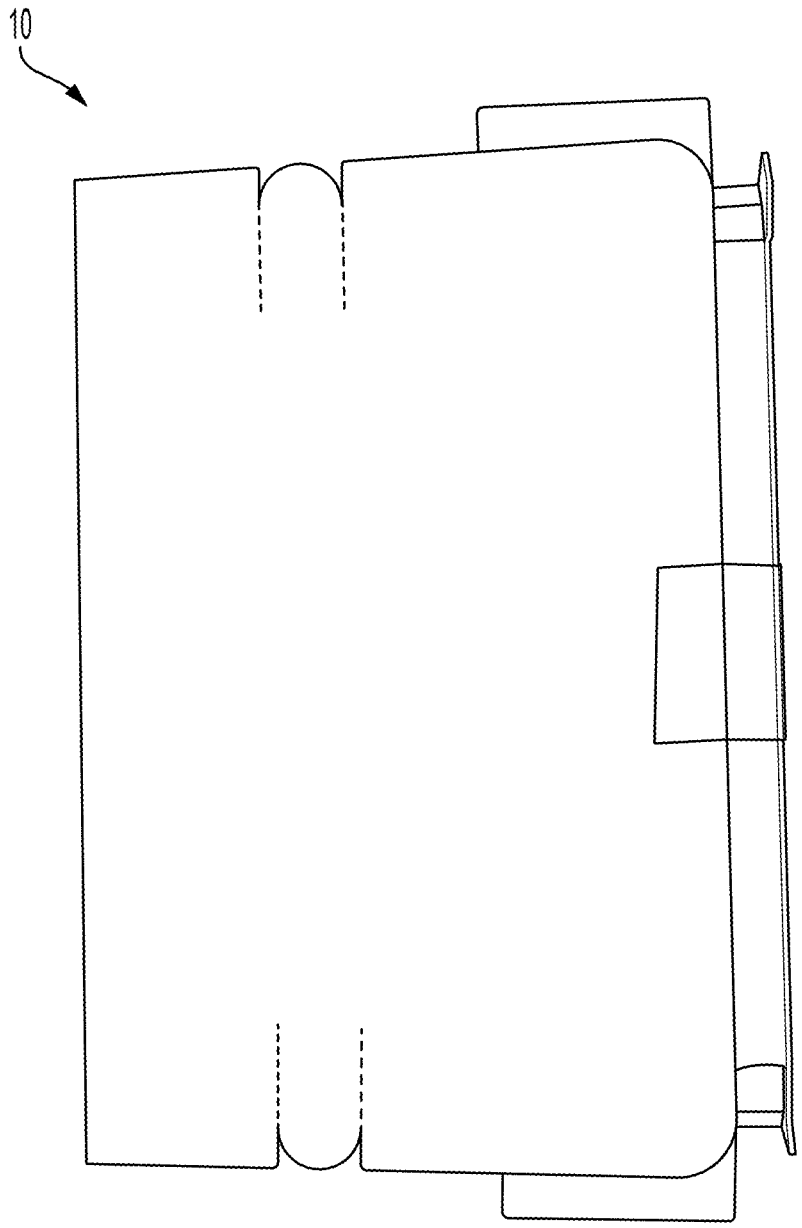
FIG. 6 is a top perspective view with the box closed.
Figure 7:
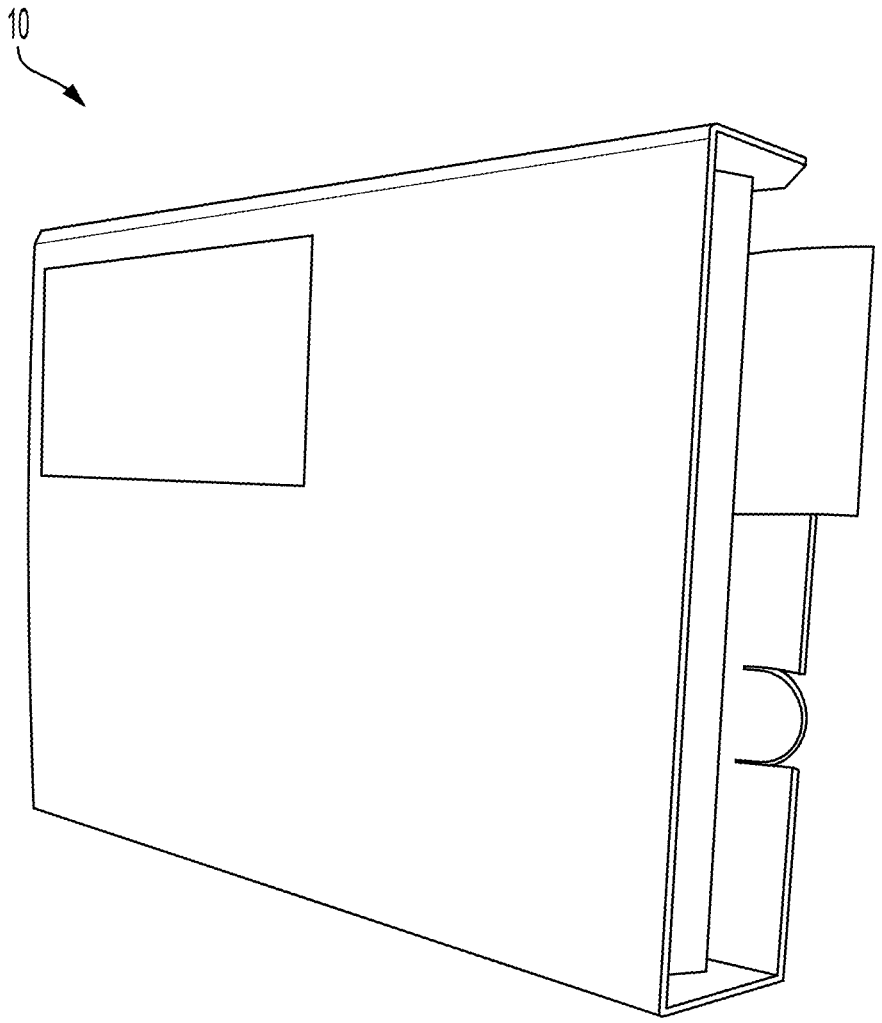
FIG. 7 is an end perspective view of the box when closed.

To use the box 10, a cardboard blank is cut as illustrated in FIG. 2. Depending on whether the box 10 will accommodate game cards 52 or top loaders 54, the space reducing tab 16 will either lie flat with the remainder of the back section 13, as shown in FIG. 5, or will be bent along the space reducing tab fold line 23 to reduce the space for the item in the back section 13, as shown in FIGS. 3 and 4. After items are placed on the back section 13, the side section fold down tabs 17 are bent so that a first part of the fold down tab is folded towards the inside of the box 10, as shown in FIGS. 4 and 5, as the side sections 14 and 15 are folded over the box items, so the fold down tabs 17 act as to acts as a weak spring and a space reducer in the second plane. The front section 12 is then folded over the items and the back section 13, and the cover section 11 is then folded over the back section 13. Tape 50 is then used to secure the cover section 11 to the back section 13. After shipping, the tear strip 46 in the cover section 11 permits easy opening of the box 10.

Various other features of this disclosure are set forth in the following claims.

The invention claimed is:

1. A box having a front section, a back section having a space reducing tab, two symmetrical side sections, each having a fold down tab, and a cover section, the front section being attached to the back section along a first front fold line with a second parallel front fold line spaced apart from the first front fold line, the front section being dimensioned to overlap all the back section, the cover section being dimensioned to overlap at least part of the back section, the cover section being attached to the front section along a first cover fold line with a second parallel cover fold line spaced apart from the first cover fold line, the two side sections being attached to opposed sides of the back section by four spaced apart side fold lines so that the size of the box is reduced as needed in one plane, and being dimensioned to fold over at least part of the back section, each fold down tab being detached on at least one side from its respective side section with a first fold line attached to the side section and a second fold line spaced apart from the first fold line so that a first part of the fold down tab can be folded towards the inside of the box when the side section is folded over the back section so that the fold down tab acts as a weak spring and a space reducer in a second plane, and the space reducing tab being detached along two opposed sides from the back section, the space reducing tab being attached to the back section along a first space reducing tab fold line toward the outside of the back section so that the space reducing tab folds upward.

2. The box according to claim 1 wherein the cover section has a tear strip parallel to the cover fold line.

* * * * *